US005345877A

United States Patent [19]

Hermes

[11] Patent Number: 5,345,877

[45] Date of Patent: Sep. 13, 1994

[54] JUNCTION FOR NEIGHBORING CAR BODIES OF A TRACK-BOUND VEHICLE, ESPECIALLY OF A MAGNETIC LEVITATION TRAIN, HAVING CABLE CONNECTED DOORS

[75] Inventor: Peter Hermes, München, Fed. Rep. of Germany

[73] Assignee: Thyssen Industrie AG, Essen, Fed. Rep. of Germany

[21] Appl. No.: 83,073

[22] Filed: Jun. 24, 1993

[30] Foreign Application Priority Data

Jul. 10, 1992 [DE] Fed. Rep. of Germany ..... 4222624

[51] Int. Cl.[5] ..... B61D 17/00

[52] U.S. Cl. ..... 105/8.1; 49/61; 49/118; 49/123

[58] Field of Search ..... 105/8.1, 343, 348; 280/400, 403; 49/36, 61 X, 68, 73.1, 116, 118, 123

[56] References Cited

U.S. PATENT DOCUMENTS 3,913,270 10/1975 Kumagai ..... 49/73.1 X
4,543,746 10/1985 Racca ..... 49/118

FOREIGN PATENT DOCUMENTS 1780178 1/1972 Fed. Rep. of Germany .
3602781 8/1986 Fed. Rep. of Germany .
679385 2/1992 Switzerland ..... 105/8.1

*Primary Examiner*—Mark T. Le
*Assistant Examiner*—S. Joseph Morano
*Attorney, Agent, or Firm*—Robert W. Becker & Associates

[57] ABSTRACT

A junction for neighboring car bodies of a track-bound vehicle has a first door guided within a first end wall of a first car body for closing a doorway of the first car body and a second door guided with an adjacent second end wall of the neighboring car body for closing a doorway in the neighboring car body. The first and the second end walls are spaced apart and delimit a space therebetween. The first and the second doors are guided at the first and the second end walls so as to be movable in opposite directions. At least one coupling element for coupling the first and the second doors extends through the first and the second end walls and the space therebetween. The first and the second doors have a substantially identical construction and substantially identical moving characteristics. The coupling element is preferably a cable and a sleeve enclosing the cable.

8 Claims, 4 Drawing Sheets

JUNCTION FOR NEIGHBORING CAR BODIES OF A TRACK-BOUND VEHICLE, ESPECIALLY OF A MAGNETIC LEVITATION TRAIN, HAVING CABLE CONNECTED DOORS

BACKGROUND OF THE INVENTION

The present invention relates to a junction between car bodies of a track-bound vehicle, especially of a magnetic levitation train, having doors within adjacent end walls of the car bodies which doors are guided within the car bodies and serve to close the doorways within the end walls.

With magnetic elevation trains extremely high velocities can be achieved. This leads, when passing through curves, to high centrifugal forces which require compensation. Such compensation is achieved with a suitably designed track, i.e., with respectively elevated curves. When a magnetic elevation train passes through such elevated curves at a velocity which is substantially below the predetermined velocity for such curves or when the train comes to a stop within such an area of the track, gravitational forces of a considerable magnitude act on the slanted train, especially on the doors closing the doorways at the end walls of the car bodies. Such doors are commonly fire protection doors of considerable weight. Accordingly, the drives for the activation of these doors must have great power. When such drives become inoperable, for example, due to a collision, a manual opening of the respective door against the gravitational forces present as a function of the tilt of the car body is very difficult or even impossible.

For reducing the forces needed to activate the doors it is known to guide the doors without play and to support the doors in a friction-reducing manner. However, with such measures only for relatively small tilts of the car body relative to the maximal possible tilt it is possible that the doors at the junction between the car bodies can be opened with relatively small forces, that is also by hand, against the effect of the gravitational forces.

It is furthermore known from German Offenlegungsschrift 36 02 781 to prestress vehicle sliding doors, especially intermediate doors of train car bodies, in the closing direction by a prestressed cable whereby the prestress is generated by a spring.

However, the prestress provided for automatically closing the intermediate doors cannot be adjusted in its effect to changing tilts of the car bodies so that on certain portions of the track the gravitational forces resulting from the tilt and the spring force for loading the cable must be overcome by a respectively high counter force in order to be able to open the doors.

It is therefore an object of the present invention to provide a junction of the aforementioned kind with which it is possible, even for a considerable tilt of the car bodies relative to the longitudinal axis of the train, to open the doors at the junction with a small force against the effect of the gravitational forces resulting from the tilt.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
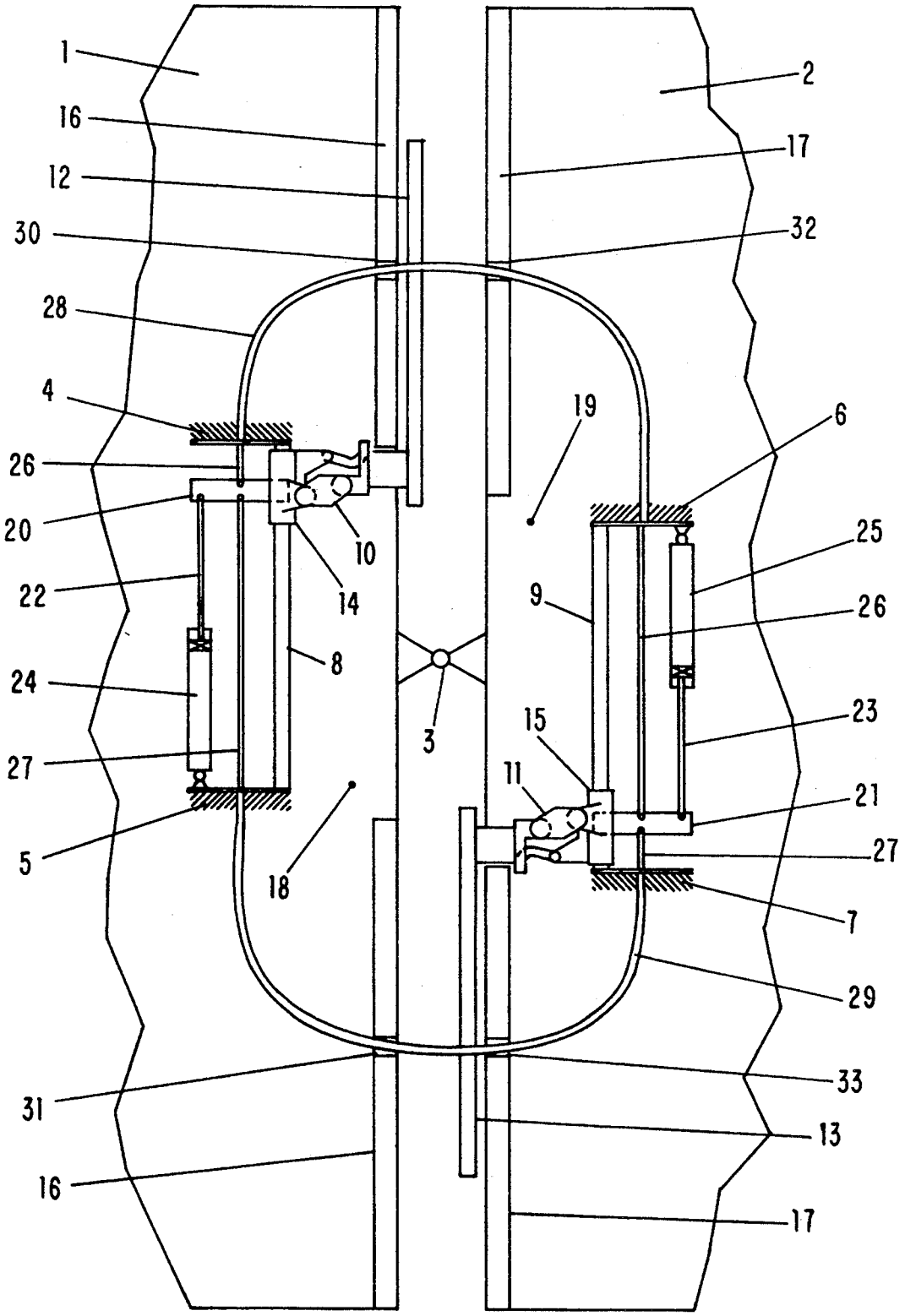
FIG. 1 shows a junction between two car bodies with the doors in the open position in a plan view, with a car body cover being removed.

The junction for neighboring car bodies of a track-bound vehicle according to the present invention is primarily characterized by:

A first door guided within a first end wall of a first car body for closing a doorway of the first car body;

A second door guided within an adjacent second end wall of the neighboring car body for closing a doorway in the neighboring car body, wherein the first and the second end walls are spaced apart and delimit a space therebetween;

The first and the second doors guided at the first and the second end walls to be movable in opposite directions; and At least one coupling element for coupling the first and the second doors extending through the first and the second end walls and the space therebetween.

According to the present invention, the coupling element, which acts as an abutment in connection with the car bodies, compensates the gravitational forces resulting from the tilt of both doors so that for the activation of the doors only a small differential force is required which results from the differences in the construction of each door and a force required for overcoming friction.

In order to be able to reduce this differential force, the doors preferably have a substantially identical construction and substantially identical moving characteristics.

In a preferred embodiment of the present invention, the coupling element is comprised of a cable and a sleeve enclosing the cable. In order to reduce the friction within the coupling element, the space between the cable and the sleeve is expediently filled with a gliding film or guide rollers or balls for the cable. The cable may be comprised of a bundle of individual cables, but may also be comprised of a homogenous, preferably profiled body, whereby for each of the two embodiments in addition to a pulling load a pressure load is also achievable.

In a preferred embodiment of the present invention, the junction further comprises a first set of actuating members connected to the first door and a second set of actuating members connected to the second door. Supports are fixedly connected to the car bodies, with each doorway having a first support arranged on one side and a second support arranged on the other side. Two of the aforementioned cables are provided, with the first one of the cables positioned on one side of the doorways of the first and the second doors and with the second one of the cables positioned on the other side of the doorways of the first and the second doors. Each one of the two cables has a first and a second end, the first end connected to the first set of actuating members and the second end connected to the second set of actuating members. The sleeve of the first cable extends between the supports on the one side of the doorways and the sleeve of the second cable extends between the supports on the other side of the doorways.

Preferably, the junction further comprises a first bellows for enclosing the sleeve of the first cable in the space between the first and the second end walls and a second bellows for enclosing the sleeve of the second cable in the space between the first and the second end walls. Expediently, each of the first and the second bellows comprises a sealing sleeve positioned at a center of the first and the second bellows between the first and the second end walls, the sealing sleeve filling the annular space between the sleeves of the first and the second cables and the first and the second bellows.

In another embodiment of the present invention, the end walls have openings and sliding sleeves positioned in the openings. The cables are guided through the sliding sleeves of the openings. Preferably, the sliding sleeves have an inner diameter that is slightly greater than an outer diameter of the sleeves. In another embodiment of the present invention, the cable is arranged in the shape of a coil in the space between the first and the second end walls and penetrates vertically displaced the first and the second end walls.

In an alternative embodiment of the present invention, the coupling element is comprised of two double-acting hydraulic cylinders and two partially flexible hydraulic lines connecting the hydraulic cylinders to one another such that the hydraulic cylinders are movable in opposite directions.

When the ends of the cable are connected to the actuating members of the doors and the sleeve is arranged in a rigid arrangement between the supports at the car bodies, a direct support of the cable at the sleeve is achieved, while the cable is freely movable at the same time.

For ensuring the relative movement of the car bodies to one another and of the end walls relative to the cable and the sleeve and for reducing wear at the junction, openings within the end walls are provided having an inner diameter which is slightly greater than the outer diameter of the sleeves of the cables.

Since the space between the end walls of the car bodies cannot be maintained free of dust and moisture, it is advantageous to arranged a bellows between the end walls of the car bodies which encloses the sleeve of the coupling element and which is able to follow the relative displacements of the car bodies.

In order to prevent gas exchange between the car bodies, which is especially desirable in the case of a fire, a sealing sleeve is positioned within the space created between the bellows and the sleeve of the coupling element at a center location between the end walls.

In an alternative embodiment of the present invention, the coupling element in the form of a cable and a sleeve is arranged in the form of a coil between the end walls of the car bodies and penetrates the end walls such that the locations of penetration are slightly vertically displaced relative to one another. Preferably, a flat connection between the end walls of the car bodies and the sleeve of the coupling elements exists which is expediently gas-tight. Relative movements of the car bodies to one another are compensated by the change of the shape of the coil.

In addition to coupling elements which are comprised of flexible and pull-resistant or pull- and pressure-resistant solid bodies, it is also possible to provide a coupled movement of the doors with a hydraulic force transmission. For example, this is achievable by two double-acting hydraulic cylinders which are connected by hydraulic lines and movable in opposite directions due to this connection. The hydraulic lines are preferably rigidly connected with the end walls of the car bodies and preferably flexible within the space between the end walls.

DESCRIPTION OF PREFERRED EMBODIMENTS

The car bodies 1, 2 of a magnetic levitation train are, as represented in FIG. 1, connected by a coupling 3. The coupling 3 may be in the form of a ball-and-socket joint that allows for free movability of the car bodies 1, 2 relative to one another as a prerequisite for the movement of each car body 1, 2 as a function of the track.

Guide rods 8, 9 are supported at supports 4, 5, 6, 7 fixedly connected to the car bodies 1, 2. Slides 14, 15 are slidable along the guide rods 8, 9 and are connected with pivoting units 10, 11 to the upper side of the doors 12, 13. A guiding and supporting construction, not represented in the drawing, is arranged at the underside of each door 12, 13 that upon displacement of the slides 14, 15, allows for the movement of the doors 12, 13, shown in the open position in the drawing, parallel to the end walls 16, 17 of the car bodies 1, 2 and subsequently into the doorways 18, 19 of the end walls 16, 17. Piston rods 22, 23 engage holders 20, 21 of the slides 14, 15. The piston rods 22, 23 belong to actuating cylinders 24, 25 supported at the supports 5, 6. Coupling elements in the form of cables 26, 27 are connected to the holders 20, 21. The sleeves 28, 29 of the cables 26, 27 are connected to the supports 4, 5, 6, 7 and extend through openings 30, 31, 32, 33 of the end walls 16, 17 of the car bodies 1, 2 above the doors 12, 13 without being connected to the openings 30, 31, 32, 33.

Figure 2:
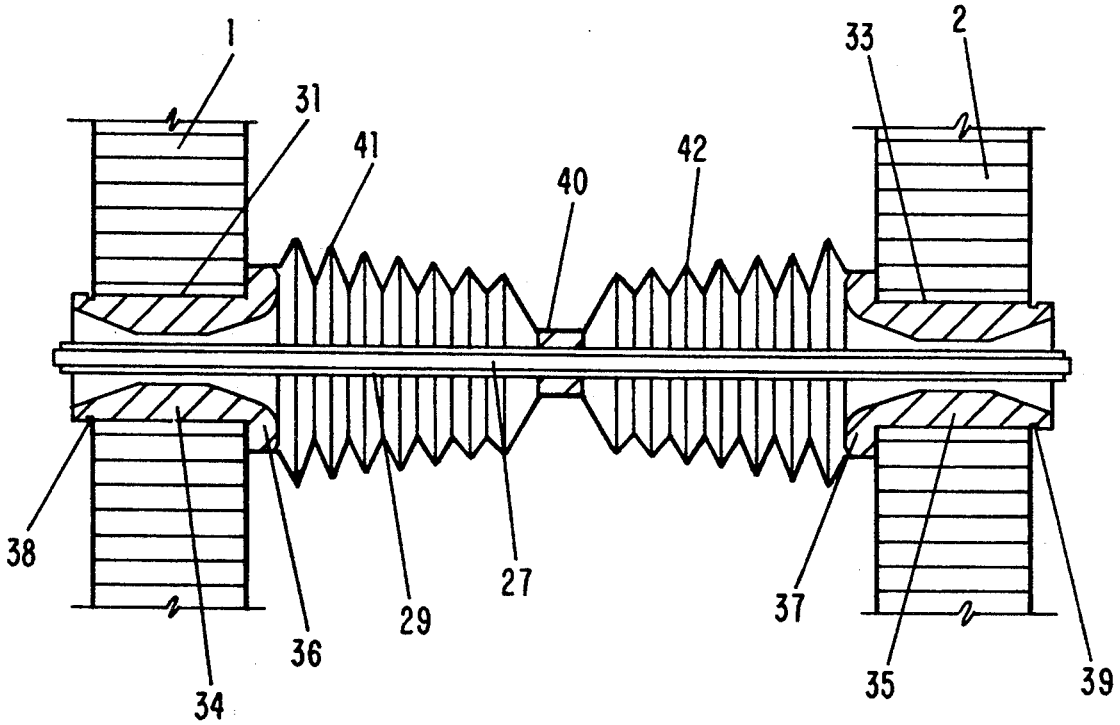
FIG. 2 shows in an enlarged representation an embodiment of the present invention for a junction having a coupling element that penetrates the end walls of the car bodies.
Figure 3:
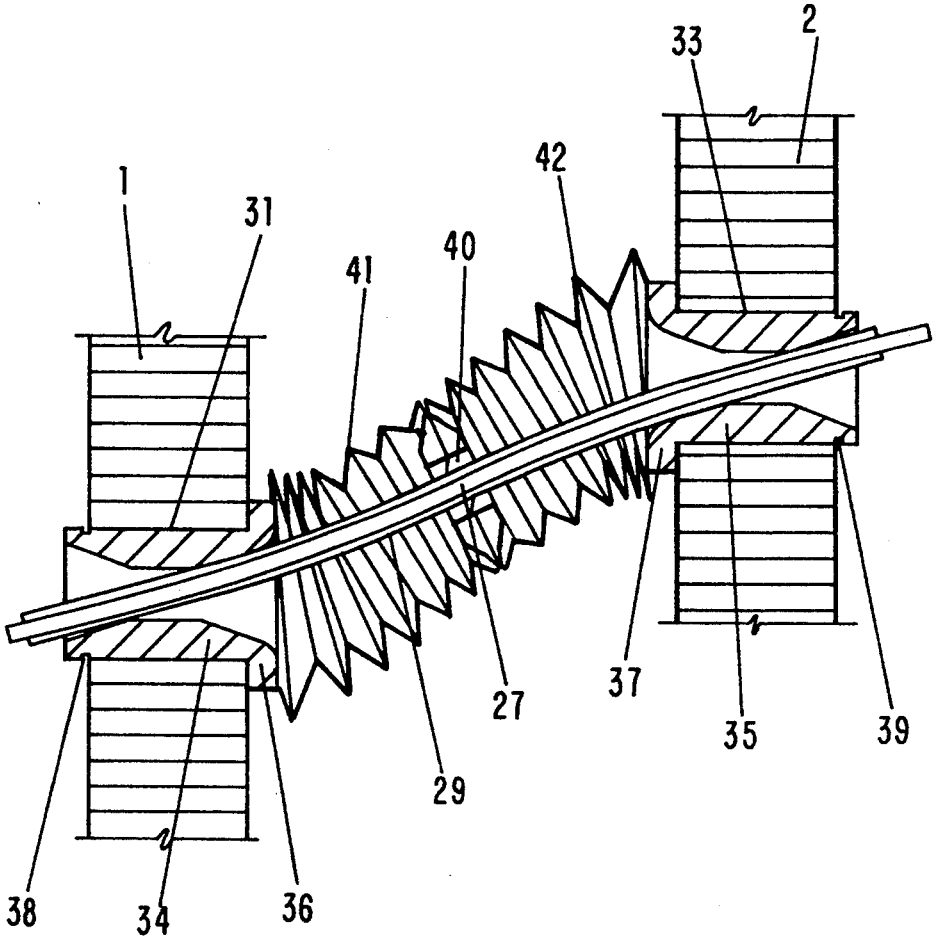
FIG. 3 shows the embodiment of FIG. 2 with the end walls being displaced relative to one another.

According to FIGS. 2 and 3, the openings 31, 33 of the end walls 16, 17 are provided with sliding sleeves 34, 35 having flanges 36, 37 and retaining rings 38, 39 on a side remote from the flanges for securing the sliding sleeves 34, 35 against displacement. The sleeve 29 penetrating the openings of the sliding sleeves 34, 35 is provided with a sealing sleeve 40 approximately at the center between the end faces 16, 17. The end sections of bellows portions 41, 42 of a bellows are connected to the flanges 36, 37 of the sliding sleeves 34, 35 and to the sealing sleeve 40. These end sections are uniformly loaded over the circumference in the radial direction with a predetermined force by non-represented clamping means. This prevents the introduction of dust and moisture into the openings of the sliding sleeves 34, 35 and thus an increased wear between the sleeve 29 and the sliding sleeves 34, 35, especially during great relative movements of the car bodies 1, 2 (FIG. 3). The force acting on the sealing sleeve 40 is expediently selected such that the sealing sleeve 40 rests with a uniform prestress at the sleeve 29 of the cable 27 so that a gas exchange between neighboring car bodies 1, 2 is prevented, which is especially important in case of a fire in one of the car bodies 1, 2.

For closing the junction, the piston rods 22, 23 within the actuating cylinders 24, 25 are retracted, and the slides 14, 15 are displaced along the guide rods 8, 9. Due to this displacement, a movement of the doors 12, 13, coupled via the swivel units 10, 11 to the slides 14, 15, into a position that closes the doorways 18, 19 results. Due to the interconnection of the two doors 12, 13 with the cables 26, 27 supported within the sleeves 28, 29 as well as due to the identical construction of the doors 12, 13 and the actuating members 8, 10, 14, 20; 9, 11, 15, 21 of the respective car bodies 1, 2, only a minimal force resulting from unpreventable friction is required for the movement of the doors 12, 13.

The movement for opening and closing the doorways of the Junction between the car bodies 1, 2 may be initiated by both actuating cylinders 24, 25 or by only one of them, with the other actuating cylinder sitting idle and not impeding the movement of the cables 26, 27.

When an especially high flexibility of the cables 26, 27 is required, which is a property counter to the pressure resistance of the cables between the supports 4, 5, respectively, 6, 7, it is expedient when the actuating cylinders 24, 25 are controlled such that one is active during closing and the other during opening of the junction. In the shown embodiment, the actuating cylinder 24 would thus be used for the closing movement and the actuating cylinder 25 for the opening movement of the doors at the junction. This is especially important when for reducing friction losses only one of the two cables 26, 27 is being used.

When the cables 26, 27 are sufficiently stable it is possible to eliminate one of the actuating cylinders 24 or 25 and the corresponding piston rod 22 or 23. In the case of an increased stability of the employed cables 26, 27 with respect to pull and pressure load, it is also possible to use only one cable 26 or 27 and only one actuating cylinder 24 or 25.

Figure 4:
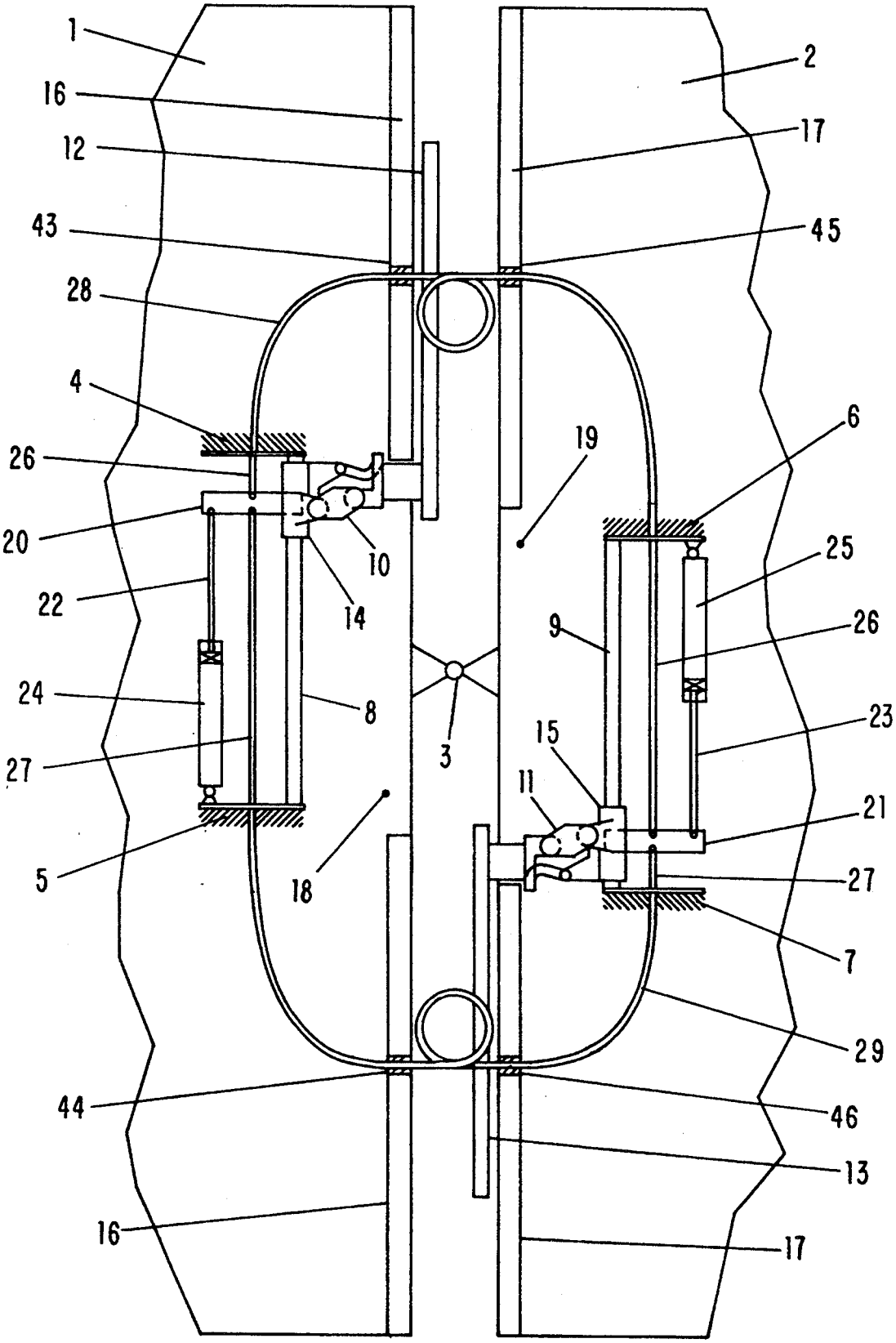
FIG. 4 shows a junction according to FIG. 1 with an alternative arrangement of the coupling elements.

In another embodiment of the present invention represented in FIG. 4, the coupling elements are guided in a different manner than in FIG. 1, with the cables 26, 27 and the enclosing sleeves 28, 29 within the area between the end walls 16, 17 of the car bodies 1, 2 being arranged in the shape of a coil. Each cable then penetrates the end walls 16, 17 vertically displaced. A rigid connection between the end walls 16, 17 and the sleeves 28, 29 of the cables 26, 27 as well as a sealing of the car bodies 1, 2 in an outward direction is achieved by clamping elements 43, 44, 45, 46 inserted into the openings 30, 31, 32, 33. Relative movements of the car bodies 1, 2 during operation of the train are compensated by changes of the diameter and the height of the coil shape of the coupling elements.

The present invention is, of course, in no way restricted to the specific disclosure of the specification and drawings, but also encompasses any modifications within the scope of the appended claims.

What I claim is:

1. A junction for neighboring car bodies of a track-bound vehicle, said Junction comprising:

a first door guided within a first end wall of a first car body for closing a doorway of the first car body;

a second door guided within an adjacent second end wall of the neighboring car body for closing a doorway in the neighboring car body, wherein said first and said second end walls are spaced apart and delimit a space therebetween;

said first and said second doors guided at said first and said second end walls to be movable in opposite directions;

at least one coupling element for coupling said first and said second doors extending through said first and said second end walls and said space therebetween; and said at least one coupling element comprised of a first component and a second component;

said first component connecting said first and second doors for transmitting forces between said first and second doors;

said second component enclosing said first component and connected to the first and the neighboring car bodies; and wherein a displacement of said first and second doors relative to the first and neighboring car bodies results in a displacement of said first component relative to said second component.

2. A junction according to claim 1, wherein said first and said second doors have a substantially identical construction and substantially identical moving characteristics.

3. A junction according to claim 1, wherein said coupling element is comprised of a cable and a sleeve enclosing said cable.

4. A junction according to claim 3, further comprising:

a first set of actuating members connected to said first door and a second set of actuating members connected to said second door;

supports fixedly connected to the car bodies, with each said doorway having a first said support arranged on one side and a second said support arranged on the other side;

wherein two said cables are provided, with a first one of said two cables positioned on said one side of said doorways of said first and said second doors and with a second one of said two cables positioned on said other side of said doorways of said first and second doors;

wherein each one of said two cables has a first and a second end, said first end connected to said first set of actuating members and said second end connected to said second set of actuating members, wherein said sleeve of said first cable extends between said supports on said one side of said doorways and said sleeve of said second cable extends between said supports on said other side of said doorways.

5. A junction according to claim 4, further comprising a first bellows for enclosing said sleeve of said first cable in said space between said first and said second end walls and a second bellows for enclosing said sleeve of said second cable in said space between said first and said second end walls.

6. A junction according to claim 6, wherein each one of said first and said second bellows comprises a sealing sleeve positioned at a center of said first and said second bellows between said first and second end walls, said sealing sleeve filling an annular space between said sleeves of said first and second cables and said first and second bellows.

7. A junction according to claim 3, wherein:

said end walls have openings and sliding sleeves positioned in said openings;

said cables are guided through said sliding sleeves of said openings; and said sliding sleeves have an inner diameter that is slightly greater than an outer diameter of said sleeves.

8. A junction according to claim 3, wherein said cable is arranged in the shape of a coil in said space between said first and said second end walls and penetrates vertically displaced said first and said second end walls.

* * * * *